United States Patent [19]

Newsom et al.

[11] Patent Number: 4,787,308

[45] Date of Patent: Nov. 29, 1988

[54] COMPACTING APPARATUS WITH PRECOMPACTION TAMPER

[75] Inventors: Horace R. Newsom, Midland; Michael W. Lockman, Lorena; Kenneth B. Boren, Dallas, all of Tex.

[73] Assignee: Mosley Machinery Company, Inc., Waco, Tex.

[21] Appl. No.: 118,723

[22] Filed: Nov. 9, 1987

[51] Int. Cl.[4] ..... B30B 15/18; B30B 7/04

[52] U.S. Cl. ..... 100/50; 100/45; 100/215; 100/218; 100/226; 100/232; 100/902; 100/52

[58] Field of Search ..... 100/215, 245, 196, 42, 100/50, 218, 41, 902, 246, 256, 45, 226, 52, 232

[56] References Cited

U.S. PATENT DOCUMENTS

| | | | |
|---|---|---|---|
| 3,501,890 | 3/1970 | Hunt | 100/42 |
| 3,608,476 | 9/1971 | Price | 100/50 X |
| 3,765,323 | 10/1973 | Hix | 100/42 X |
| 3,839,953 | 10/1974 | Hirsch | 100/45 |
| 4,007,677 | 2/1977 | Fox | 100/245 X |
| 4,100,849 | 7/1978 | Pelton | 100/41 |
| 4,202,262 | 5/1980 | Claas et al. | 100/50 |
| 4,238,998 | 12/1980 | Herring et al. | 100/215 X |
| 4,601,238 | 7/1986 | Davis, Jr. et al. | 100/45 |
| 4,627,341 | 12/1986 | Sudbrack et al. | 100/41 |
| 4,669,375 | 6/1987 | Newsom et al. | 100/902 X |

*Primary Examiner*—Andrew M. Falik

*Attorney, Agent, or Firm*—Hubbard, Thurman, Turner & Tucker

[57] ABSTRACT

An apparatus for compacting articles including a compaction chamber adapted to receive articles to be compacted. An article chute is positioned to feed articles into the compaction chamber. A tamper is mounted in the article chute for precompacting articles in the compaction chamber. A compaction platen is mounted for back and forth movement in the compaction chamber. In one embodiment, the force applied by the platen to the articles in the compaction chamber is measured when the platen is at a selected point of movement in the compaction chamber. If the force measured is less than a selected amount, additional articles are added to the compaction chamber. If, on the other hand, the force is at least equal to a selected amount, the articles are ejected from the compaction chamber. An another embodiment, the tamper is movable between an open and a closed position. When the articles are so densely precompacted that the tamper is unable to move fully to the closed position, the platen is operated to compact the precompacted articles. The force that the tamper applies to the articles may be regulated to control the final weight of the compacted articles.

26 Claims, 8 Drawing Sheets

COMPACTING APPARATUS WITH PRECOMPACTION TAMPER

BACKGROUND OF THE INVENTION

A. Field of the Invention

The present invention relates to methods and apparatus for compacting low-density articles and more particularly to a method and apparatus for compacting low density articles, such as aluminum beverage containers, into "biscuits" of substantially uniform size and weight without weighing the articles prior to compaction.

B. Description of the Prior Art

In recent years, there has been substantial interest in recycling metals in order to conserve natural resources and to conserve energy and capital in connection with refining metals from ores. A metal of particular interest and for recycling is aluminum and aluminum beverage can collection centers have become commonplace. The cans are collected at the collection center for transportation back to the manufacturer.

Empty aluminum beverage cans are of very low density and in order to make their transportation more efficient, they need to be compacted into a more dense form. In the industry, aluminum beverage cans are compressed into compact blocks known as "biscuits" weighing between 18 and 22 pounds. Approximately 700 empty aluminum beverage cans are required to make a biscuit. It is of course, however, impractical in the interest of efficiency to count out 700 cans. Also, because the cans arrive at the collection center in various states of compaction—i.e., some of the cans are crushed or flattened—it is not possible to make a standard biscuit from a particular volume of cans; 20 pounds of flattened cans occupies substantially less volume than 20 pounds of unflattened cans.

There are machines in existence which weigh the cans prior to compaction. Such machines typically include a compaction chamber into which the cans are introduced and a ram which moves into and out of the compaction chamber to compress the cans. Such machines also include weighing mechanisms for monitoring the weight of cans fed to the compaction chambers. Such machines are well adapted for large scale applications, but they are complex and are not well adapted for small scale use.

Accordingly, it is an object of the present invention to provide an improved compaction apparatus and method that overcomes the shortcomings of the prior art.

It is a further object of the present invention to provide an apparatus and method for compacting articles into biscuits of substantially uniform size and weight without the need to weight the uncompacted articles.

SUMMARY OF THE INVENTION

The foregoing and other objects are accomplished by the apparatus of the invention which includes an compaction chamber adapted to receive articles to be compacted. A tamper is provided for precompacting the articles in the compaction chamber and compaction means are movable into and out of the compaction chamber for compacting the articles. In one embodiment of the invention, means are provided for measuring the compacting force applied to the articles by the compaction means at a selected point of the movement of the compaction means into the compaction chamber. It has been found with aluminum cans that regardless of the density of the uncompacted material, a substantially uniform compacting force is necessary to produce a uniform biscuit. The apparatus includes means for introducing additional articles into the compaction chamber if the compaction force is less than a selected amount, whereupon the compaction means is operated again until the selected compaction force is reached. Means are provided for ejecting the compacted articles from the compaction chamber when the selected compaction force is attained.

In another embodiment of the invention, the tamper is movable back and forth until a desired level of precompaction is achieved, at which level the tamper is unable to move to a fully closed position. The force that the tamper exerts on the articles can be regulated thereby to control the amount of precompacted articles the tamper forces into the compaction chamber. Means are provided for determining when the tamper is unable to close fully and for actuating the compaction means to compact the precompacted articles. The tamper may then be operated again to precompact an additional amount of articles in the compaction chamber, which is then compacted by the compaction means to make a full biscuit.

DESCRIPTION OF THE PREFERRED EMBODIMENT

Figure 1:
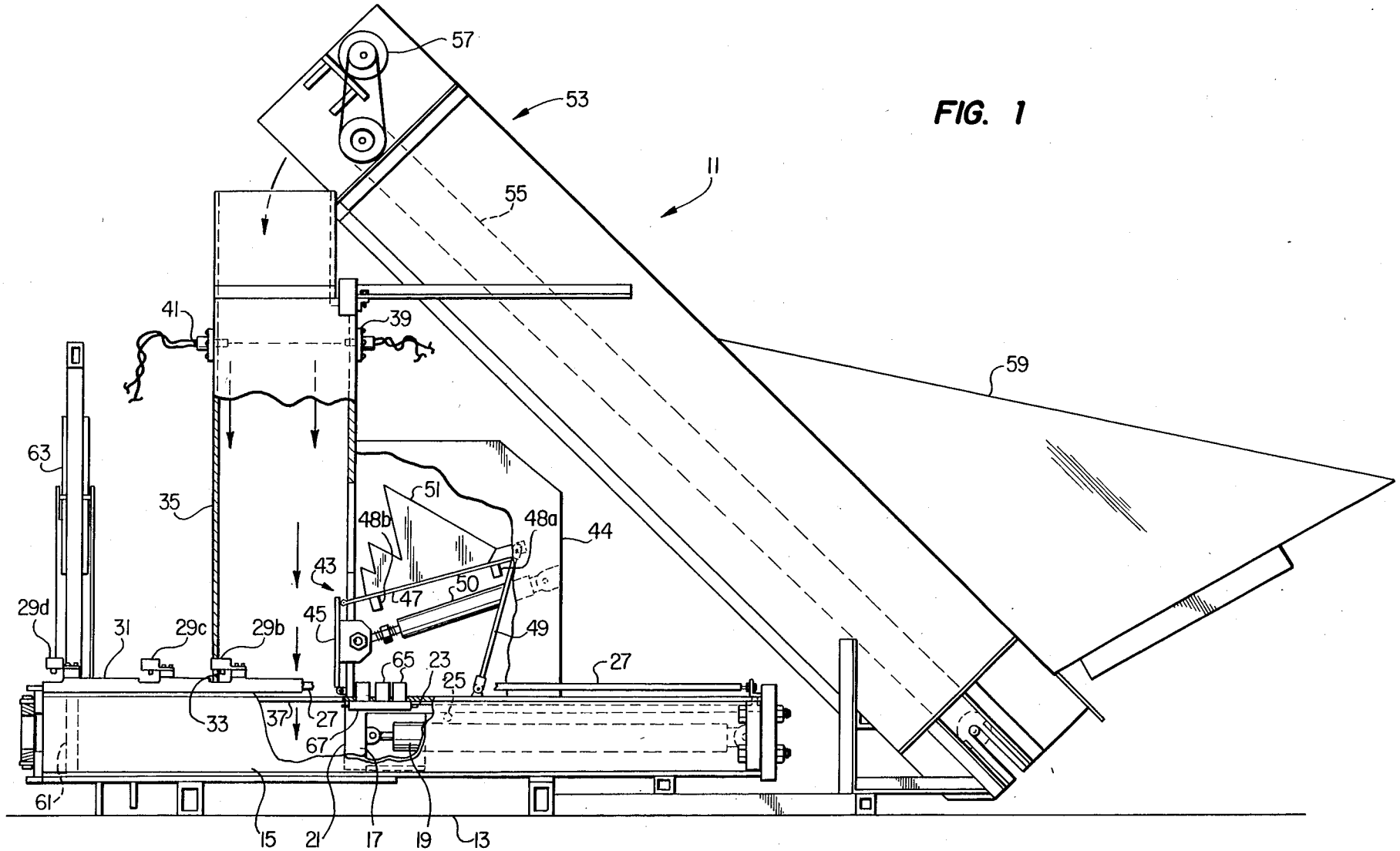
FIG. 1 is a side elevation view of the apparatus of the present invention.

Referring now to the drawings, and first to FIG. 1, the apparatus of the present invention is designated generally by the numeral 11. Apparatus 11 is mounted on a skid 13 and it includes an elongated box-like structure which forms a compaction chamber 15. A platen 17 is positioned for movement back and forth in compaction chamber 15 by means of a hydraulic ram 19. Platen 17 is an L-shaped structure which includes a front portion 21 and a top portion 23 that is supported by a roller 25.

Figure 7:
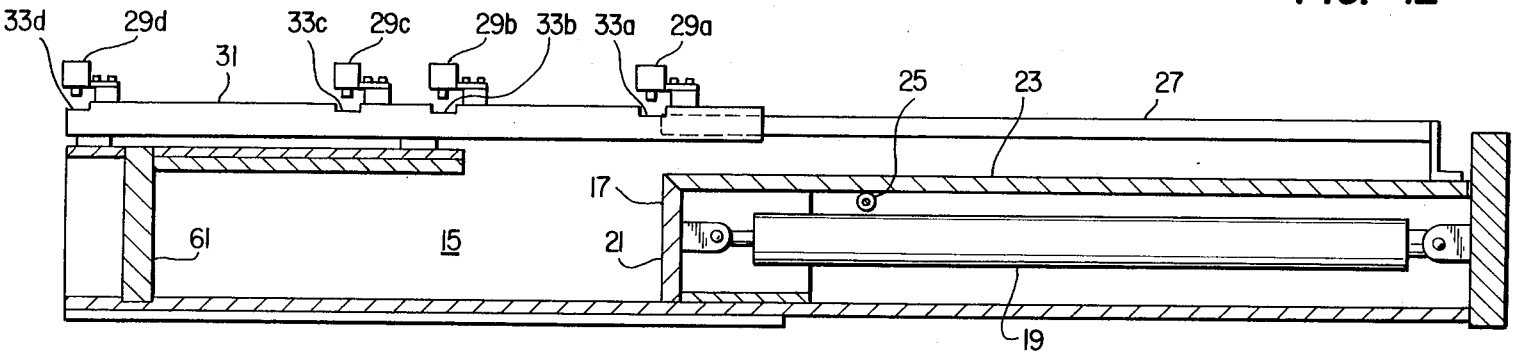
FIG. 7 is a partial sectional view showing details of the means for determining the position of the platen of the present invention.

Referring particularly to FIGS. 1 and 7, the position of platen 17 within compaction chamber 15 is monitored by a position sensor system which includes a follower rod 27 connected to top portion 23 of platen 17 and a plurality of proximity switches 29*a–d* mounted on a tube 31 overlying windows 33*a–d*, respectively. Follower rod 27 moves with platen 17 and when the end of rod 27 enters a particular window 33, a particular proximity switch 29 is actuated. In FIG. 1, follower rod 27 is broken for purposes of clarity of illustration.

Referring again to FIG. 1, articles are fed into compaction chamber 15 through an article chute 35, which is positioned above an opening 37 in compaction chamber 15. A photo cell 39 and a light 41 are positioned near the top of chute 35 for monitoring the level of articles in chute 35.

Figure 3:
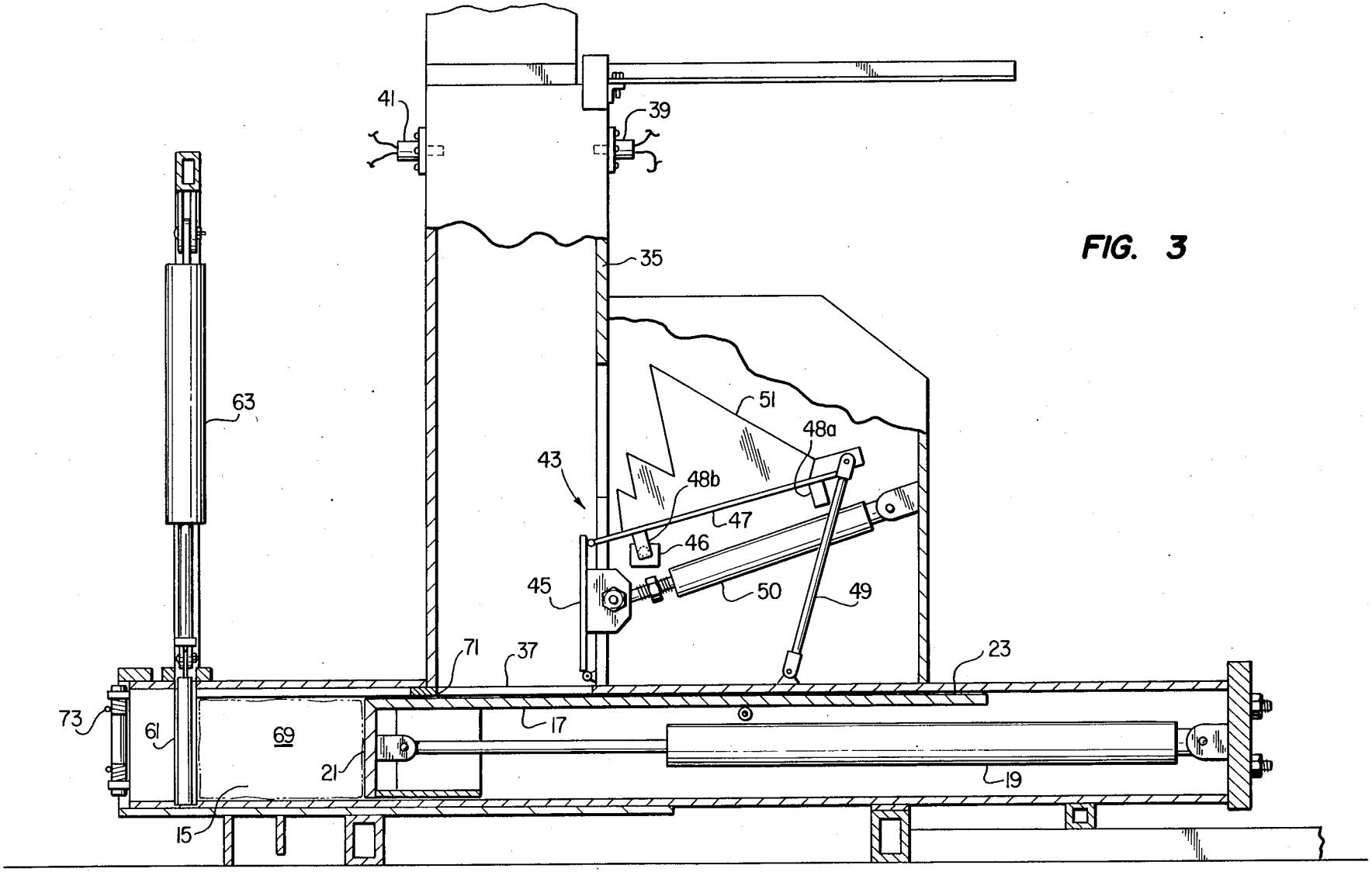
FIG. 3 is a side sectional view similar to FIG. 2 showing details of the operation of the apparatus of the present invention.
Figure 4:
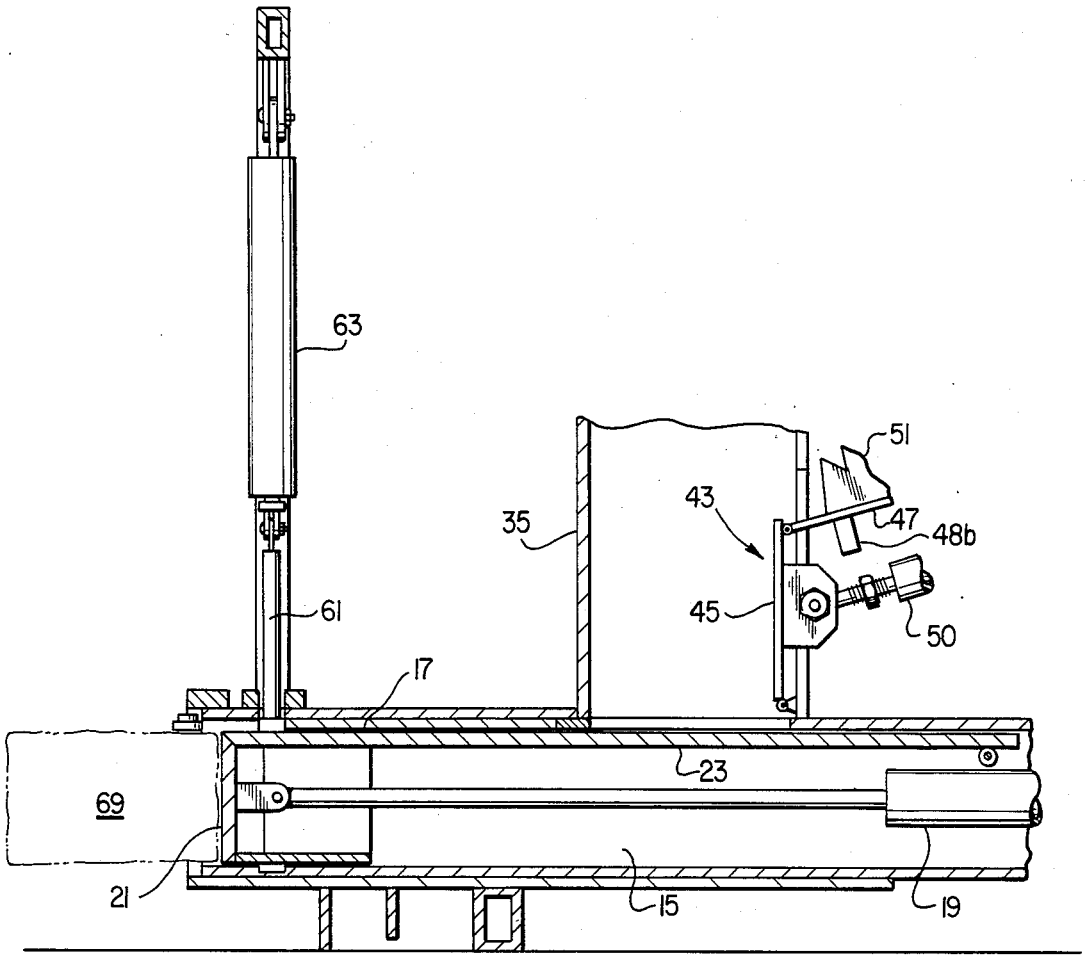
FIG. 4 is a partial sectional view showing the ejection of a compacted biscuit from the compaction chamber.
Figure 6:
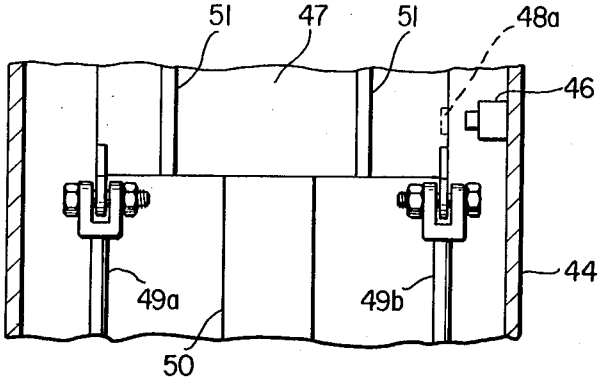
FIG. 6 is a partial sectional view taken along line 6—6 of FIG. 2 showing details of the tamper of the present invention and means for determining whether the tamper is closed.

Articles are fed from chute 35 into compaction chamber 15 by gravity and by means of a tamper designated generally by the numeral 43. Tamper 43 includes a tamper door 45 hingedly mounted adjacent opening 37 and an agitator plate 47 hingedly mounted to tamper door 45 and supported by swing arms 49*a* and 49*b* (FIG. 6). Tamper door 45 and agitator plate 47 are movable into and out of chute 35 between an open position, as shown in FIGS. 1, 3 and 4, and a closed position as shown in FIG. 2.

Agitator plate 47 has mounted thereto a plurality of agitator claws 51. As tamper door 45 and agitator plate 47 swing into chute 35, agitator claws 51 agitate and pull down the articles in chute 35 and prevent bridging of the articles. Tamper door 45 serves to precompact articles in compaction chamber 15. Tamper door 45 and agitator plate 47 are moved into and out of chute 35 by a hydraulic ram 50. As will be described in greater detail hereinafter, in one embodiment of the invention, means are provided for regulating the pressure of hydraulic fluid supplied to ram 50 in order to control the amount of articles precompacted by tamper door 45. Tamper 43 is enclosed in a protector shroud 44.

Figure 2:
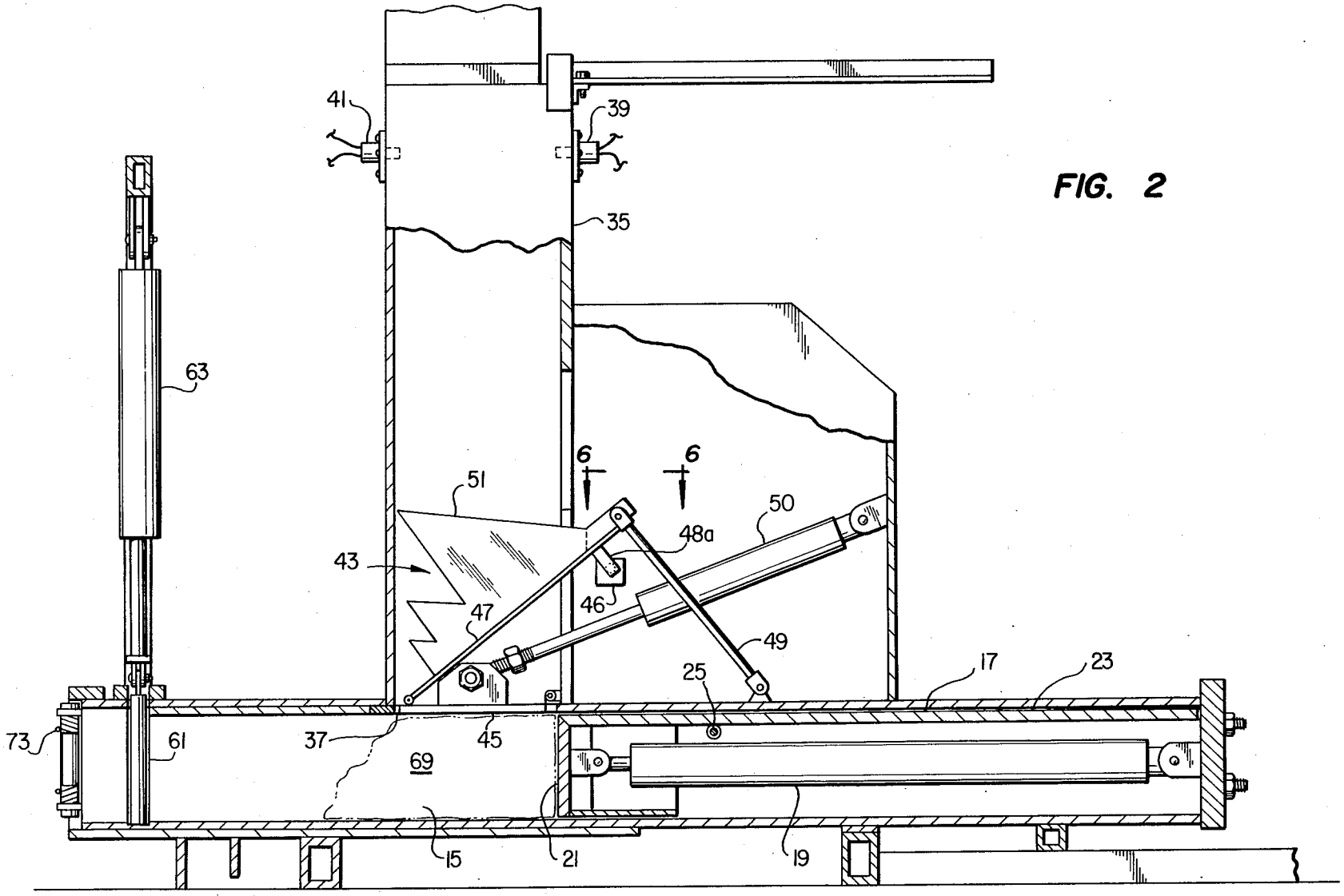
FIG. 2 is a side sectional view showing details of the apparatus of the present invention.

In one embodiment of the invention, the operation of platen 17 to compact the articles precompacted in compaction chamber 15 is initiated by the inability of tamper door 45 to move to the fully closed position, as shown in FIG. 2. The inability of tamper door 45 to move to the fully closed position indicates that a sufficient precompacted density of articles has been attained. Accordingly, in one embodiment of the invention, means are provided for indicating that tamper door 45 has arrived at the closed position. The means includes a proximity switch 46 mounted to the wall of protector shroud 44. Proximity switch 46 is actuated by the proximity of an indicator plate or target 48*a* mounted to the back of agitator plate 47, which registers with proximity switch 46 when tamper door 45 is in the closed position. A second indicator plate target 48*b* is also mounted to the back of agitator plate 47 so as to register with proximity switch 46 when tamper door 45 is in the open position. As tamper door 45 moves from the open position, as shown in FIG. 3, to the closed position, as shown in FIG. 2, target 48*a* moves into proximity with proximity switch 46. If tamper door 45 cannot move to the fully closed position, then target 48*a* cannot move into proximity with proximity switch 46.

Articles are fed to article chute 35 by means of a conveyor system designated generally by the numeral 53. Conveyor system 53 includes a conveyor belt 55 that is driven by a motor 57. Articles are supplied to conveyor belt 55 from a hopper 59 that is filled periodically. As will be described in greater detail hereinafter, motor 57 of conveyor system 53 is operated periodically to supply cans to chute 35 when the level of articles within shute 35 falls below photo cell 39.

The end of compaction chamber 15 opposite platen 17 is normally closed by a door 61. Door 61 is opened and closed by a hydraulic ram 63. As will be explained in greater detail, when a biscuit of the appropriate weight is formed, ram 63 causes door 61 to open to permit the completed biscuit to be ejected from compaction chamber 15.

Apparatus 11 includes a number of pieces of equipment that are illustrated schematically and described hereinafter but which have been omitted from FIG. 1 for purposes of clarity of illustration. For example, apparatus 11 includes a hydraulic system for operating rams 19, 50 and 63, which includes a pump, various valves, conduits and the like. Apparatus 11 also includes an electrical control system, which includes a programmable controller for receiving inputs from various switches and sensors and supplying outputs to operate the various valves and motors. A portion of the hydraulic and control system that is illustrated in FIG. 1, however, is a plurality of pressure switches 65, which are used in one embodiment of the invention and which are mounted to a manifold 67. In one embodiment, there are three pressure switches 65 which are set at a selected low pressure, a selected medium pressure, and a selected high pressure. Pressure switches 65 sense the pressure supplied to ram 19 during the operation of apparatus 11, which is proportional to the force applied to the articles. As will be described in greater detail, when the pressure supplied to ram 19 at a selected point in its operation is less than the selected set point of the high pressure switch, apparatus 11 is actuated to introduce more articles into compaction chamber 15 for further compaction. When the pressure exceeds the selected set point of the high pressure switch, then apparatus 11 is actuated to eject the completed biscuit from compaction chamber 15.

Referring now to FIG. 2, platen 17 is again shown in the retracted position clear of opening 37 of compaction chamber 15. Tamper door 45 is, however, shown in the closed position in which a charge of precompacted articles 69 are shown within compaction chamber 15. Tamper door 45 may be operated a selected number of times by extending and retracting ram 50 prior to extending ram 19, which in turn extends platen 17, to introduce an initial charge of articles into compaction chamber 15.

Referring now to FIG. 3, platen 17 is shown extended to the shear position in which articles 69 are compressed between front portion 21 of platen 17 and door 61. A shear plate 71 is positioned in compaction chamber 15 adjacent opening 37 which cooperates with platen 17 to shear off any articles that are not fully within compaction chamber 15 when platen 17 moves to the shear position.

In the embodiment of the invention that operates by sensing the force applied to the articles by platen 17, when platen 17 reaches the shear position, as indicated by a proximity switch 29*b* (FIG. 1), the condition of pressure switches 65 is internally noted. If the high pressure switch is not actuated, then ram 19 is actuated to retract platen 17 to the retracted position, as shown in FIGS. 1 and 2, whereupon ram 50 is actuated to operate tamper 43 to introduce additional articles into compaction chamber 15.

Figure 5:
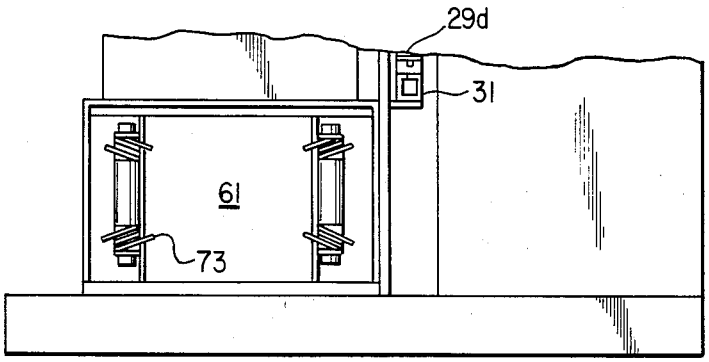
FIG. 5 is a partial end view of the apparatus of the present invention showing means for preventing ejected compacted biscuits from being drawn back into the compaction chamber.

However, if the high switch is actuated, then ram 19 is extended slightly further to move platen 17 to a "biscuit made" position, as indicated by the actuation of proximity switch 29*c*, in which a final compacting force is applied to articles 69. Then, referring to FIG. 4, ram 63 is actuated to move door 61 to the open position and ram 19 is actuated to move platen 17 to an eject position, as indicated by the actuation of proximity switch 29*d*, in which front portion 21 of platen 17 is outward of door 61. As is best shown in FIG. 5, a plurality of spring fingers 73 are positioned to the sides of door 61. Spring fingers 73 engage the compacted biscuit 69 to prevent biscuit 69 from being pulled back into compaction chamber 15 when platen 17 is retracted.

Figure 8:
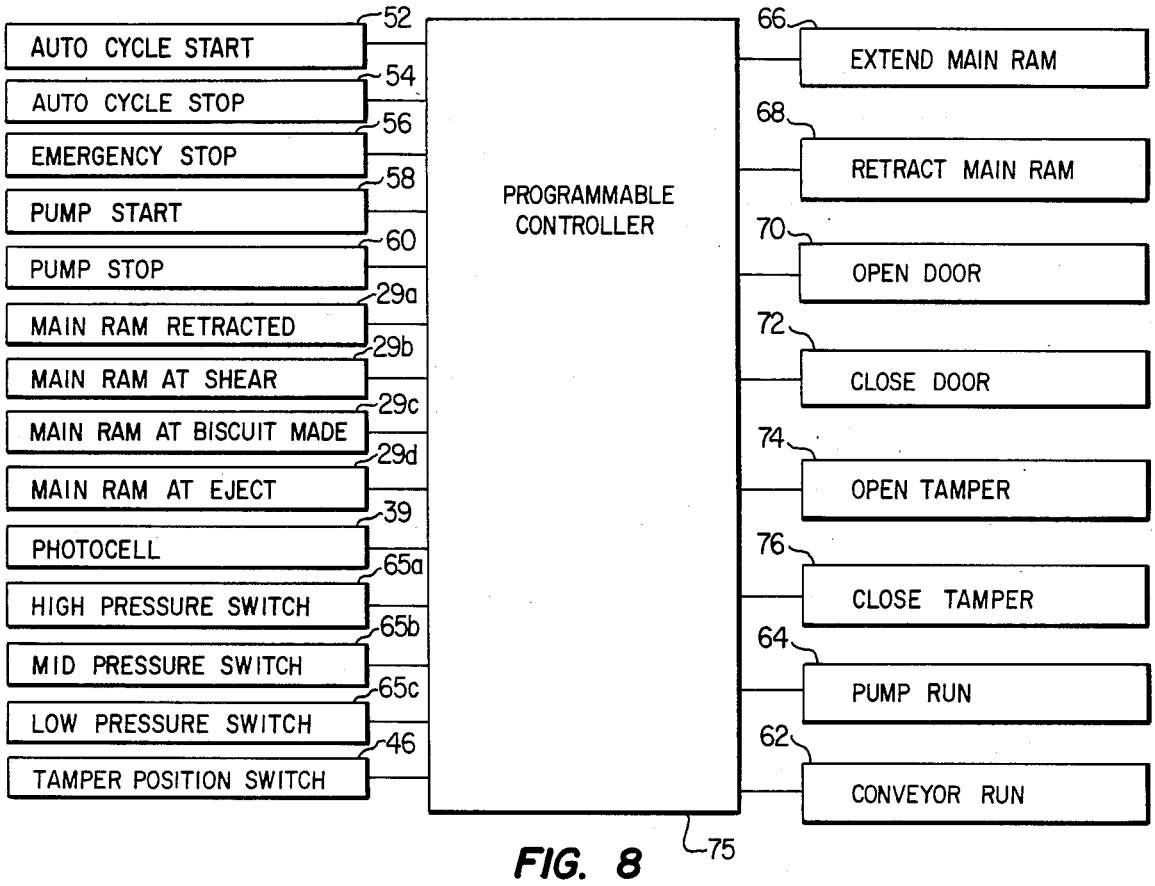
FIG. 8 is a system block diagram of the inputs and outputs of the programmable controller which operates the apparatus of the present invention.

Referring now to FIG. 8, apparatus 11 is preferably operated by a programmable controller 75, which in the preferred embodiment is a Sysmac-S6 programmable controller manufactured by Omron Electronics Inc., which is described in Omron User's Manual Cat. No. W10-E3-1. The inputs to programmable controller 75 are shown on the left side of FIG. 8 and the outputs from programmable 3 controller are shown on the right. The inputs illustrated in FIG. 8 include both those for the platen force controlled embodiment as well as those for the alternative tamper closing force controlled embodiment.

The inputs include manual inputs for auto cycle start 52, auto cycle stop 54, emergency stop 56, pump start 58, and pump stop 60. The foregoing manual inputs are all manual switches that are located conveniently on apparatus 11.

The next four inputs to programmable controller 75 are received from proximity switches 29, which indicate the position of main ram 19 and platen 17. The main ram position inputs consist of main ram retracted input 29*a*, main ram at shear input 29*b* , main ram at biscuit made input 29*c*, and main ram at eject input 29*d*.

The next input to programmable controller 75 is the signal from photo cell 39, which indicates whether or not chute 35 is full. Then, there are three inputs to programmable controller 75 that are the signals from pressure switches 65 which consist of high pressure switch 65*a*, mid pressure switch 65*b*, and low pressure switch 65*c*, which are used in the platen force operated embodiment of the invention. The alternative, tamper force operated, embodiment of the invention does not use inputs 65*a–c*; rather, that embodiment includes a tamper proximity switch input 46, which is the signal from proximity switch 46 and which indicates whether tamper door 45 is open or closed.

Figure 9:
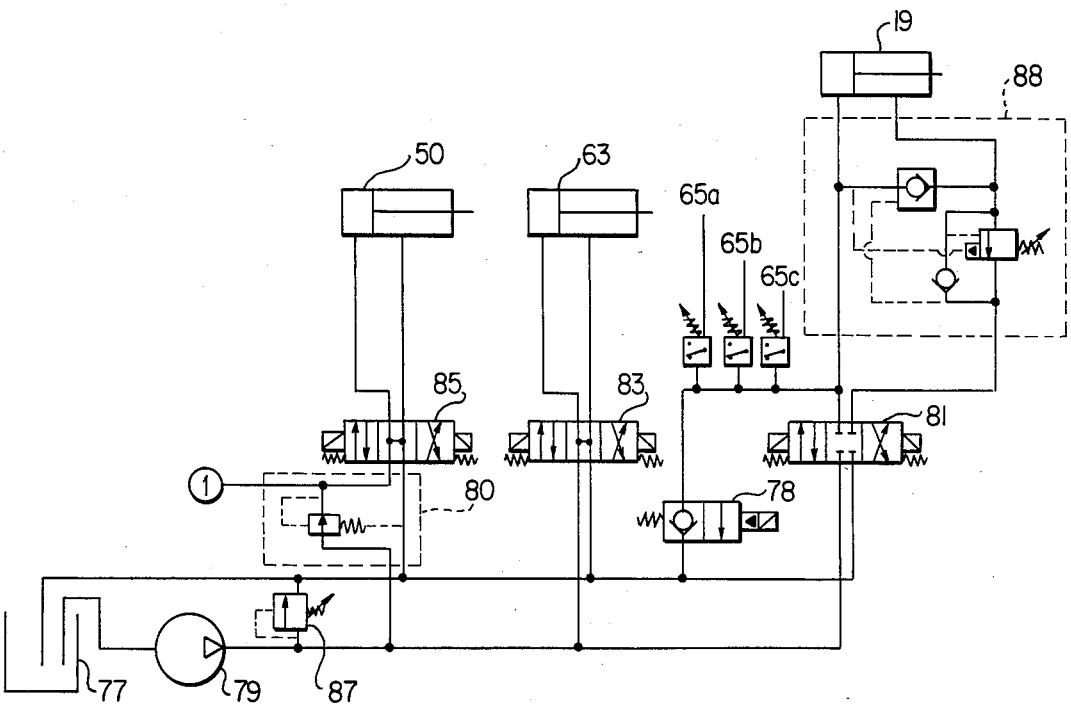
FIG. 9 is a schematic diagram of the hydraulic system of the present invention.

The outputs of programmable controller 75 are adapted to run the systems of apparatus 11. The conveyor run output 62 operates motor 57 (FIG. 1) in response to the processed signals received from photo cell 39. The remaining outputs of programmable controller 75 operate the hydraulic system of apparatus 11, which is shown in FIG. 9.

The hydraulic system includes a reservoir 77 and a pump 79, which is controlled by the pump run 64 output of programmable controller 75. The hydraulic system includes a solenoid operated valve 81 for operating main ram 19. Valve 81 receives signals from the extend main ram 66 and retract main ram 68 outputs of programmable controller 75 to extend and retract main ram 19.

The hydraulic system also includes a solenoid operated valve 83 which is operable to control ram 63 to operate door 61. Valve 83 receives signals from the open door 70 and close door 72 outputs of programmable controller 75. Finally, the hydraulic system includes a solenoid operated valve 85 which operates ram 50 to open and close tamper 43. Valve 85 receives signals from the open tamper 74 and close tamper 76 outputs of programmable controller 75. A manually settable pressure reducing valve 80 regulates the pressure of hydraulic fluid supplied to ram 50 in order to regulate the force that tamper door 45 applies to the articles in compaction chamber 15.

The hydraulic system also includes a relief valve 87 and a dump valve 78 which relieve over-pressure conditions in the hydraulic system. The hydraluic system also includes a regeneration loop 88, which increases the efficiency of operation of main ram 19.

Figure 12:
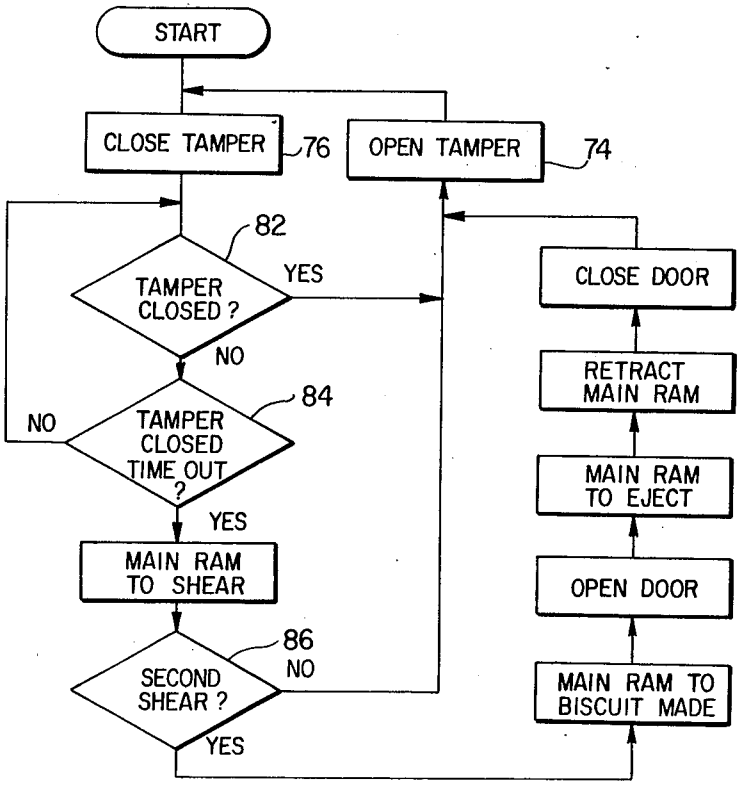
FIG. 12 is a flow chart of the compaction routine of an alternative embodiment of the present invention.
Figure 11:
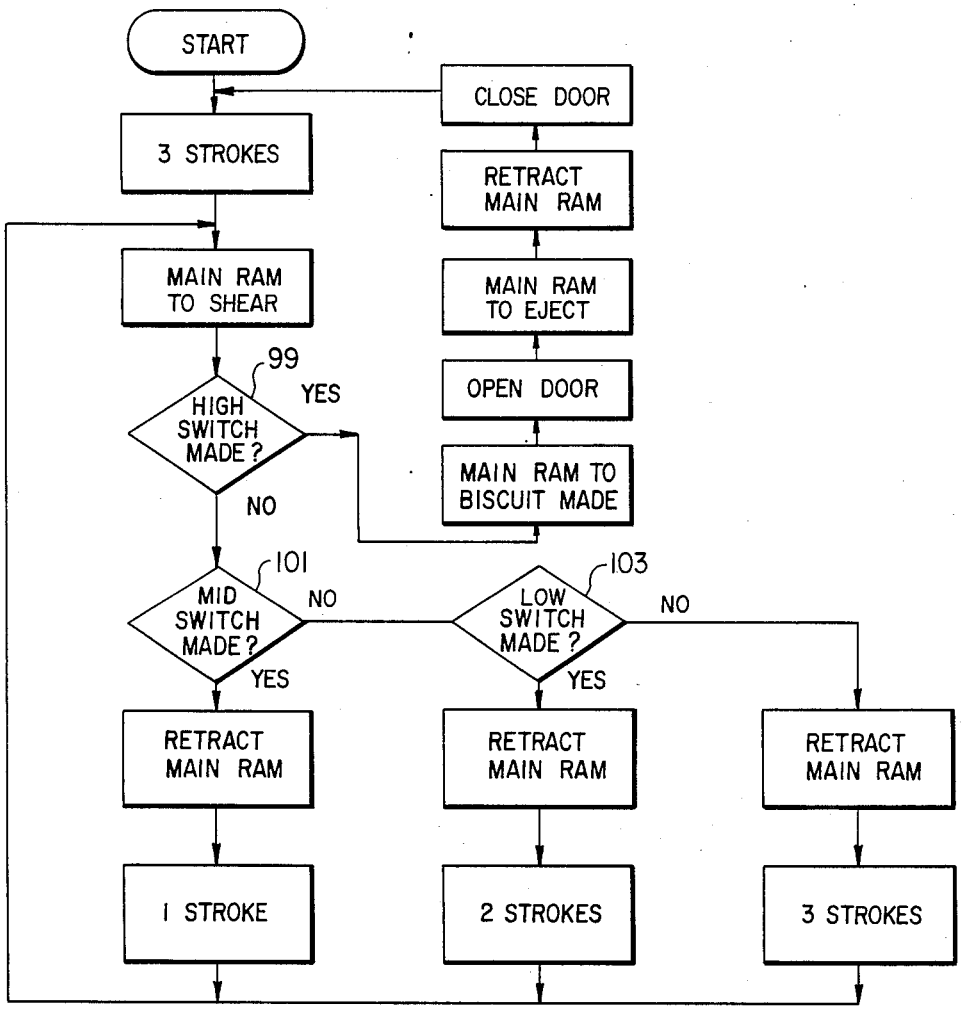
FIG. 11 is a flow chart of the compaction routine of one embodiment of the present invention.
Figure 10:
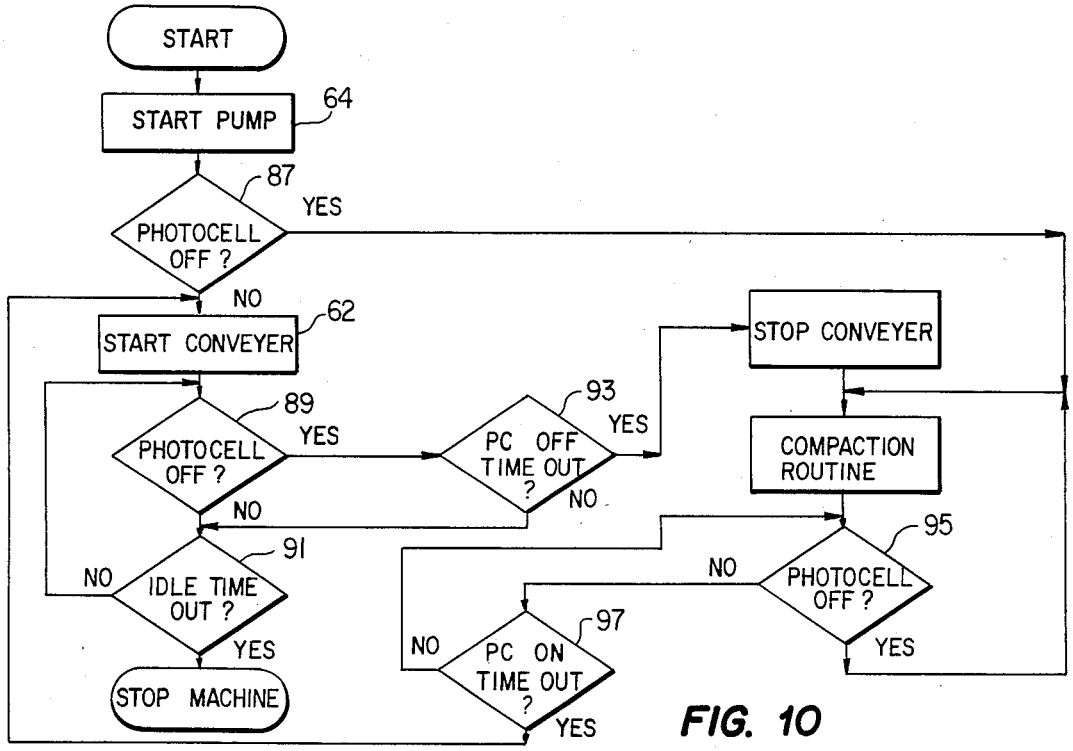
FIG. 10 is a flow chart of the start-stop routine of the present invention.

Referring now to FIG. 10, there is depicted a flow chart of the preferred logic for the automatic cycle start/stop routine. Upon turning on the auto cycle start switch 52, programmable controller 75 delivers a signal at pump run output 64 to start pump 79, which continues to run throughout the routine. At decision block 87, the condition of photo cell 39 is checked. If the photo cell 39 is off, which indicates that chute 35 is full of articles, then one of alternative compaction routines, which are set forth in FIGS. 7, 11 and 12 is initiated. If, on the other hand, photo cell 39 is not off, which indicates that chute 35 is not full of articles, then programmable controller 75, at conveyor run output 62, actuates conveyor system 53 to deliver cans to chute 35.

At decision block 89, the condition of photo cell 39 is again checked. If the photo cell is not off, a timer in programmable controller 75, indicated in FIG. 6 by decision block 91, is started. If the timer of decision block 91 times out while photo cell 39 remains not off, that indicates that the conveyor system 53 is out of articles and programmable controller 75 shuts down the machine. If, on the other hand, photo cell 39 at decision block 89 is off, then a timer represented by decision block 93 is started. The timer of decision block 93 discriminates between a true photo cell off condition, which indicates that chute 35 is full, and a transient photo cell off condition, which indicates that an article has fallen past photo cell 39 but that chute 35 is not full. If the timer of decision block 93 times out, then programmable controller 75 signals conveyor system 53 to stop and it initiates the compaction routine.

After the initiation of the compaction routine, the condition of photo cell 39 is continuously monitored at decision block 95. As long as photo cell 39 remains off, the compaction routine continues. If, on the other hand, photo cell 39 goes on, indicated by a "no" at decision block 95, then a photo cell on timer, indicated at decision block 97 is started. The photo cell on timer of decision block 97 allows the level of articles within chute 35 to fall substantially below photo cell 39. When the timer of decision block 97 times out, conveyor 53 is again started. The timer of decision block 97 prevents the rapid starting and stopping of conveyor system 53. When the conveyor system 53 starts again, the routine described above through decision blocks 89–93 is repeated.

Referring now to FIG. 11, the platen force controlled compaction routine embodiment of the invention is depicted. At the start of the compaction routine, main ram 19 and ram 50, which operates tamper 43, are in their retracted positions. Programmable controller 75 causes tamper 43 to make three strokes, with each stroke including the closing and opening of tamper 43.

After programmable controller 75 has operated tamper 43 to make three strokes, main ram 19 is extended to the shear position, whereupon the conditions of pressure switches 65*a–c* are checked. The condition of high pressure switch 65*a* is indicated at decision block 99; the condition of mid pressure switch 65*b* is indicated at decision block 101; and, the condition of low pressure switch 65*c* is indicated at decision block 103. If the pressure supplied to main ram 19 is less than the selected set pressure of low switch 65*c*, which is indicated by a no answer at each of decision blocks 99–103, programmable controller 75 operates main ram 19 to retract, and then it operates tamper 43 to make three more strokes. If the hydraulic pressure in ram 19 is greater than the selected set point of low pressure switch 65*c* but less than the set point of mid pressure switch 65*b*, which is indicated by a "yes" at decision block 103 but "no's" at decision blocks 99 and 101, programmable controller 75 operates main ram to retract and it operates tamper 43 to make two more strokes. If the pressure of main ram 19 is greater than the selected set point of mid pressure switch 65*b*, but less than that of high pressure 65*a*, which is indicated by a "yes" at decision block 101 and a "no" at decision block 99, main ram 19 is again retracted and tamper is caused to take one more stroke. After the foregoing strokes of tamper 43, main ram 19 is extended again to the shear position whereupon the conditions of pressure switches 65*a–c* is again checked.

If the pressure in main ram 19 is at any time greater than the set point of high pressure switch 65*a*, which is indicated by a "yes" at decision block 99, the biscuit is of sufficient weight and programmable controller 75 initiates the eject sub-routine, which consists of extending main ram 19 to the biscuit made position, opening door 61 by actuation of ram 63, extending ram 19 to the eject position, as shown in FIG. 4, retracting main ram 19 and closing door 61. After completion of the ejection sub-routine, the compaction routine starts over and it continues until apparatus 11 stops automatically, as described with respect to FIG. 6, or until the operator turns off the machine.

Referring now to FIG. 12, there is illustrated the compaction routine of the tamper force operated alternative embodiment of the invention. After start of the routine, programmable controller 75 produces a signal at closed tamper output 76. The condition of proximity switch 46, which indicates that tamper door 43 is fully closed, is monitored at decision block 82. Also, a timer, indicated at decision block 84 is started. If tamper door 43 moves to the fully closed position, which is indicated by a "yes" at decision block 82, then programmable controller 75 produces a signal at open tamper output 74 which causes tamper door 43 to move back to the open position, whereupon the tamper is again operated to close to precompact more articles in compaction chamber 15. The closing and opening of the tamper continues until articles are so densely precompacted in compaction chamber 15 that tamper door 43 cannot move to the fully closed position. The inability of tamper door 43 to move to the fully closed position is indicated by a "yes" at decision block 84, which causes programmable controller 75 to move main ram 19 to the shear position.

It has been found that by appropriate sizing of compaction chamber 15, a suitable biscuit is produced by two cycles of operating tamper 43 until tamper door 45 will not close fully and compaction by main ram 19 and platen 17. Thus, programmable controller 75 includes a counter, which is indicated by decision block 86. If main ram has moved to shear only once during a compaction cycle, which is indicated by a "no" at decision block 86, then the tamper is signalled to open and the compaction subroutine just described is repeated. If, on the other hand, main ram 19 has moved to the shear position a second time, which is indicated by a "yes" at decision block 86, then the eject subroutine is initiated, which consists of moving main ram 19 to the biscuit made position, opening door 61 by actuation of ram 63, extending main ram 19 to the eject position, retracting main ram 19 and closing door 61. After completion of the ejection subroutine, the tamper is signalled to open and the compaction routine starts over. The compaction routine continues until the apparatus stops automatically, as described with respect to FIG. 10, or until the operator turns off the machine.

Accordingly, it is seen that the apparatus of the present invention is operable in one of two modes, depending upon the programming of programmable controller 75. In one mode, tamper 43 is operated a selected number of times to precompact articles in compaction chamber 15. Platen 17 is then moved by main ram 19 to the shear position, at which point the conditions of pressure switches 65*a–c* are checked. The pressure indicated by pressure switches 65*a–c* is directly proportional to the force applied to the articles by platen 17. If the force applied by platen 17 exceeds a selected level, then a biscuit of proper size and weight is made. If, on the other hand, the force applied to the articles is less than the selected level, then the operation of the apparatus is repeated until the selected level of compacting force is achieved.

In the alternative mode of operation, the tamper 43 is operated successively until articles are so densely precompacted in compaction chamber 15 that ram 50 is unable to supply enough force to move tamper door 45 to the fully closed position. The pressure of hydraulic fluid supplied to tamper ram 50 may be adjusted with pressure reducing valve 80 so that an appropriate level of precompaction is achieved. Then, main ram 19 is actuated to move platen 17 to the shear position. After platen 17 reaches the shear position, it is retracted and tamper 43 is again operated until it is unable to precompact any more articles in compaction chamber 15. After the second series of operations of tamper 43, the precompacted articles are compacted by platen 17 with the articles compacted on the first cycle and the completed biscuit is ejected. In both modes of operation, the weight of the completed biscuit is determined by the force applied to the articles. In neither mode is it necessary to weight the articles prior to compaction.

It may thus be seen that the apparatus and method of the present invention are well adapted to satisfy the objects of the invention. The apparatus and method produce biscuits of substantially uniform weight without the need for complex weighing and totalling devices. The efficient compact design makes the apparatus appropriate for small-scale operations.

Further modifications and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the size, shape and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. Apparatus for compacting articles, which comprises:

a compaction chamber adapted to receive articles to be compacted;

an article chute positioned to feed articles into said compaction chamber;

a tamper positioned in said article chute, said tamper being movable between an open position and a closed position to precompact articles in said compaction chamber;

a compacting platen movably mounted in said compaction chamber to compact articles precompacted by said tamper;

means for determining if said tamper has moved to said closed position;

and means for moving said compacting platen to compact said precompacted articles when said tamper is unable to move fully to said closed position.

2. The apparatus as claimed in claim 1, including:

means for ejecting compacted articles from said compaction chamber.

3. The apparatus as claimed in claim 2, wherein said ejecting means includes:

a door operable to open and close said compaction chamber;

means for opening said door;

and means for extending said platen to an eject position after said door opening means has opened said door, thereby to eject articles compacted in said compaction chamber.

4. The apparatus as claimed in claim 1, wherein said tamper includes:

a tamper door pivotally mounted in said article chute and movable between said open position in which articles may enter said compaction chamber and said closed position;

and means for moving said tamper door between said open and closed positions.

5. The apparatus as claimed in claim 4, wherein said means for determining if said tamper has moved to said closed position includes a proximity switch.

6. The apparatus as claimed in claim 1, including means for regulating the force applied to the articles by the tamper.

7. Apparatus for compacting articles, which comprises:

a compaction chamber adapted to receive articles to be compacted;

compaction means movable into said compaction chamber for compacting the articles;

means for measuring the compacting force applied to the articles by said compaction means at a selected point of the movement of said compaction means into said compaction chamber;

and means for introducing more articles into said compaction chamber if said force applied by said compaction means is less than a selected level.

8. The apparatus as claimed in claim 7, wherein said compaction means includes:

a platen positioned for movement into and out of said compaction chamber;

and fluid operated actuator means for moving said platen into and out of said compaction chamber.

9. The apparatus as claimed in claim 8, wherein said force measuring means includes means for measuring the fluid pressure supplied to said actuator means when said platen is at said selected point.

10. The apparatus as claimed in claim 9, wherein said pressure measuring means includes:

proximity switch means for signalling when said platen is at said selected point;

and pressure switch means for signalling when said fluid pressure is at least equal to said selected level.

11. The apparatus as claimed in claim 7, wherein said means for introducing more articles into said compaction chamber include:

an article chute positioned to feed articles into said compaction chamber.

12. The apparatus as claimed in claim 11, wherein said means for introducing more articles into said compaction chamber further includes:

a tamper movably positioned in said article chute and movable between an open position in which articles may enter said compaction chamber and a closed position in which articles are precompacted in said compaction chamber;

and means for moving said tamper between said open and closed positions.

13. The apparatus as claimed in claim 12, including means for agitating articles in said article chute.

14. The apparatus as claimed in claim 13, wherein:

said tamper includes a tamper door pivotally mounted in said article chute;

and said agitating means includes an agitator plate pivotally connected to said tamper door and at least one agitator claw connected to said agitator plate.

15. The apparatus as claimed in claim 11, including means for agitating articles in said article chute.

16. Apparatus for compacting articles, which comprises:

a compaction chamber adapted to receive articles to be compacted;

an article chute positioned to feed articles into said compaction chamber;

a compacting platen movably mounted in said compaction chamber, said platen being movable between an open position in which articles in said article chute may enter said compaction chamber and a shear position in which articles within said compaction chamber are compacted;

means for measuring the force exerted by said platen upon articles in said compaction chamber when said platen is in said shear position; and, means for retracting said platen to said open position if said force measured by said measuring means is less than a selected level.

17. The apparatus as claimed in claim 16, including:

tamper means for precompacting articles in said compaction chamber, said tamper means being movable between an open position in which articles may enter said compaction chamber and a closed position in which articles are precompacted in said compaction chamber;

and means for operating said tamper means when said force measured by said measuring means is less than said selected level.

18. The apparatus as claimed in claim 17, including means for ejecting compacted articles from said compacting chamber when said force measured by said measuring means is at least equal to said selected level.

19. The apparatus as claimed in claim 18, wherein said ejecting means includes:

a door operable to open and close said compaction chamber;

and means for opening said door when said force exerted by said platen is at least equal to a selected level.

20. The apparatus as claimed in claim 19, including:

means for extending said platen to an eject position after said door opening means has opened said door, thereby to eject articles compacted in said compaction chamber.

21. The apparatus as claimed in claim 16, including:

tamper means for precompacting articles in said compaction chamber when said platen is in said open position.

22. The apparatus as claimed in claim 21, wherein said taper means includes:

a tamper door pivotally mounted in said article chute and movable between an open position in which articles may enter said compaction chamber and a closed position in which articles are precompacted in said compaction chamber;

and means for moving said tamper door between said open and closed positions.

23. Apparatus for compacting articles, which comprises:

a compaction chamber adapted to receive articles to be compacted;

compaction means movable into said compaction chamber for compacting the articles;

means for measuring the compacting force applied to the articles by said compaction means at a selected point of the movement of said compaction means into said compaction chamber;

means for introducing more articles into said compaction chamber if said force applied by said compaction means at said selected point is less than a selected level;

and means for ejecting compacted articles from said compaction chamber when said force applied by said compaction means at said selected point is at least equal to said selected level.

24. The apparatus as claimed in claim 23, wherein said ejecting means includes:

a door operable to open and close said compaction chamber;

means for opening and closing said door;

and means for extending said compaction means to a position outward of said door.

25. The apparatus as claimed in claim 24, including means for preventing compacted articles ejected through said door from being drawn back into said compaction chamber when said compaction means is retracted.

26. Apparatus for compacting articles, which comprises:

a compaction chamber adapted to receive articles to be compacted;

tamper means for precompacting articles in said compaction chamber, said tamper means being movable between an open position in which articles may enter said compaction chamber and a closed position in which articles are precompacted in said compaction chamber;

compacting platen means for compacting precompacted articles in said compaction chamber;

and means for operating said compacting platen means when said tamper means is unable to move to said closed position.

* * * * *